US006611970B2

(12) United States Patent
Back et al.

(10) Patent No.: US 6,611,970 B2
(45) Date of Patent: Sep. 2, 2003

(54) BATH FOR GENERATING WATER VIBRATION WAVE

(75) Inventors: Sang Duck Back, Incheon (KR); Hoon Her, Seoul (KR)

(73) Assignee: Back San OMB Co., Ltd., Incheon (KR)

( * ) Notice: Subject to any disclaimer, the term of this patent is extended or adjusted under 35 U.S.C. 154(b) by 0 days.

(21) Appl. No.: 10/209,080

(22) Filed: Aug. 1, 2002

(65) Prior Publication Data

US 2003/0028961 A1 Feb. 13, 2003

(30) Foreign Application Priority Data

Aug. 7, 2001 (KR) ..... 2001-47379

(51) Int. Cl.[7] ..... A47K 3/10
(52) U.S. Cl. ..... 4/541.1; 4/491
(58) Field of Search ..... 4/491, 541.1, 559; 601/55, 78, 101, 160

(56) References Cited

U.S. PATENT DOCUMENTS 4,406,162 A * 9/1983 Hark ..... 73/148

FOREIGN PATENT DOCUMENTS

| | | | | |
|---|---|---|---|---|
| DE | 1158009 | * 11/1963 | ..... | 4/541.1 |
| GB | 2242828 | * 10/1991 | | |
| NO | 84868 | * 3/1955 | ..... | 4/541.3 |

* cited by examiner

*Primary Examiner*—Charles E. Phillips
(74) *Attorney, Agent, or Firm*—Bacon & Thomas, PLLC

(57) ABSTRACT

The invention relates to a bath for generating water vibration wave which may massage the whole body, facilitate blood circulation, and increase the effects of a diet and various treatments by vibrating as well as circulating water by means of vibration blades.

According to the aspect of the invention, there is provided with a bath for generating water vibration wave comprising a bath 2 which has a water reservoir portion 3, a vibration generation means 10 which is positioned at one side of the bath 2, a vibration member 20 which is connected to the vibration generation means 10 and extended downwardly into the water reservoir portion 3, and a plurality of vibration blades 23 which are mounted at the vibration member 20 in a predetermined interval and vibrate as well as circulate the water in the bath 2;

wherein the vibration generation means 10 includes a support member 14 fixed at the bath 2 and a piezo actuator 16 which is fixed at the support member 14 and vibrated when the electricity is supplied.

2 Claims, 3 Drawing Sheets

BATH FOR GENERATING WATER VIBRATION WAVE

FIELD OF THE INVENTION

The invention relates to a bath for generating water vibration wave, and more particularly to a bath for generating water vibration wave which may massage the whole body, facilitate blood circulation, and increase the effects of a diet and various treatments by vibrating as well as circulating water by means of vibration blades.

BACKGROUND OF THE INVENTION

Conventionally, as fatness treatment method, a diet treatment which limits the amount of calory consumption and an exercise treatment which increases the amount of exercise and so on have usually been utilized. However, the prior treatment methods like the above require individual will as well as patience, and occasionally causes unfavorable side effects.

In one hand, a physical treatment machine of hydrotherapy has also been used in order to treat fatness that taps only a definite part of a user's body strongly and continuously by the water sprayed at high pressure. By the way, the hydrotherapy utilizing said physical treatment machine is very troublesome because, in order to treat various parts of the body, the user must respectively spray the water to respective parts of the body for a long time.

Accordingly, the inventor invented a bath for generating water vibration wave and treatment method utilizing the bath which increases a physical massage effect by vibrating as well as circulating the water by means of vibration blades and by giving water vibration energy to the whole body of the user, and which easily treats fatness and remarkably relieves pain by faclilitating the blood circulation and the metabolism in the body organization. The utilization of said bath for generating water vibration wave may decrease fatness and relieve pain remarkably.

The above bath for generating water vibration wave uses a vibration motor which includes an eccentric weight at the driving shaft as a vibration source. By the way, because the weight of said vibration motor is heavy and the size of said motor is large, a lot of electric power is required in order to vibrate the motor for generating water vibration wave. And, because the size of said bath should be large owing to the motor, the space around the bath may not be effectively utilized and the design of said bath is limited so much. Further, because the weight of the vibration motor is heavy and the vibration of the motor is directly transmitted to the bath, the noise increases when the bath is vibrated. And, said bath is unable to control the vibration condition differently and promptly for different conditions of a patient.

SUMMARY OF THE INVENTION

The invention is created to solve the above described problems and so the object of the invention is to provide a bath for generating water vibration wave whose structure is simple and whose weight is light, and which generates the most appropriate water vibration wave with a small amount of electric power. Further, the object of the invention is to provide a bath for generating water vibration wave which may minimize the noise and control the vibration condition most appropriately.

According to the aspect of the invention, there is provided with a bath for generating water vibration wave comprising a bath 2 which has a water reservoir portion 3, a vibration generation means 10 which is positioned at one side of the bath 2, a vibration member 20 which is connected to the vibration generation means 10 and extended downwardly into the water reservoir portion 3, and a plurality of vibration blades 23 which are mounted at the vibration member 20 in a predetermined interval and vibrate as well as circulate the water in the bath 2;

wherein the vibration generation means 10 includes a support member 14 fixed at the bath 2 and a piezo actuator 16 which is fixed at the support member 14 and vibrated when the electricity is supplied.

DETAILED DESCRIPTION OF THE INVENTION

A preferred embodiment of the invention will be described in detail below by referring to the accompanying drawings.

Figure 1:
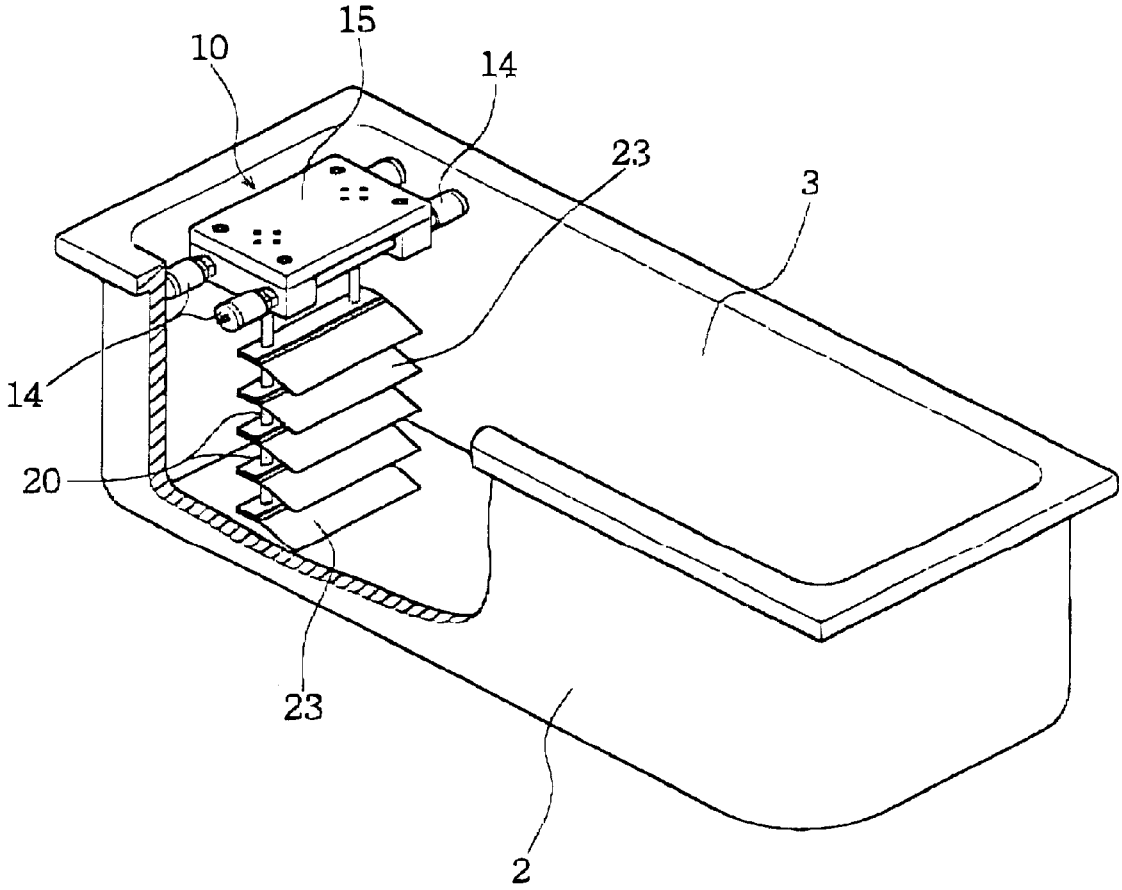
FIG. 1 is a perspective view of an embodiment according to the invention.
Figure 2:
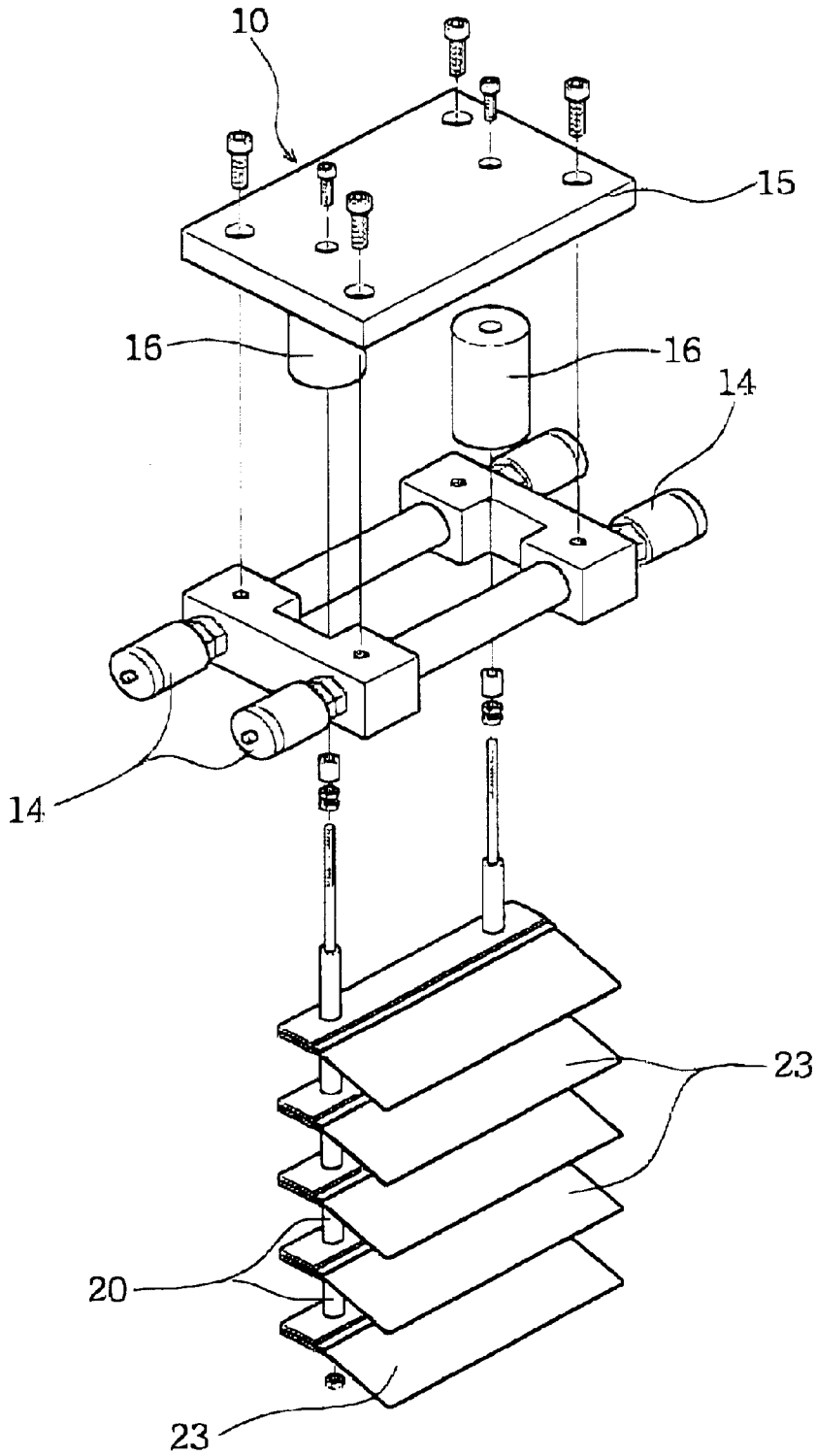
FIG. 2 is a partial view of the embodiment.
Figure 3:
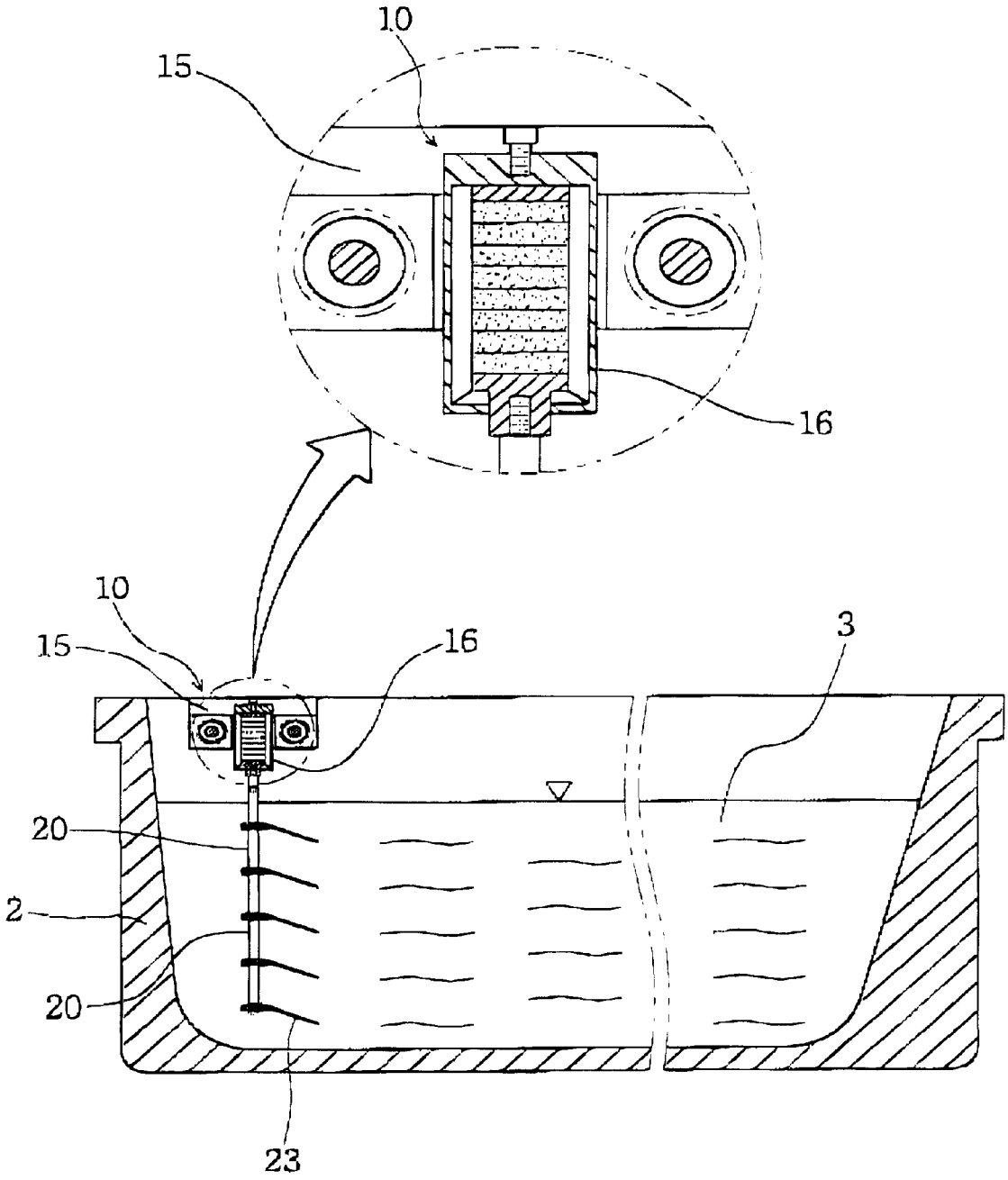
FIG. 3 is the sectional view of the embodiment.

FIG. 1 is a perspective view of an embodiment according to the invention. FIG. 2 is a partial view of the embodiment, and FIG. 3 is the sectional view of the embodiment. As shown in the drawings, the bath for generating water vibration wave according to the invention comprises a vibration generation means 10 positioned at one side of the bath 2 which has a water reservoir portion 3. This vibration generation means 10 has largely a support plate 15 supported by a shock-absorbing support member 14 which is fixed at the inner wall of the bath 2 in horizontal direction, and a cylindrical piezo actuator 16 which is hung to the support plate 14 in vertical direction.

A plurality of disk type piezo element pieces are piled up in the piezo actuator 16, and said piezo element pieces are periodically expanded and contracted in the vertical direction by the supplied power source. The upper side of the piezo actuator 16 is fixed at the bottom of the support plate 15 and two of shaft type vibration members are fixed at the bottom of the piezo actuator 16, and extended downwardly in the water reservoir portion 3, and a plurality of vibration blades 23 are mounted at the vibration member 20 in a predetermined interval.

Accordingly, when said piezo element pieces of the piezo actuator 16 are expanded and contracted in the vertical direction, the vibration member 20 and the vibration blades 23 are vibrated in the upper and lower direction by the vibration power so that the water in the bath 2 is vibrated and circulated in the water reservoir portion 3. The water vibration wave which is vibrated and circulated in the water reservoir portion 3 massages the whole body of a user and facilitates blood circulation by giving vibration power to the whole body of the user. Further, when the user appropriately tunes the vibration period and the vibration strength of the vibration means 10 according to the health condition of the user or the purpose of treatment or various conditions of treatment, the fatness or the pain of the body may be efficiently decreased.

Therefore, because the bath for generating water vibration wave of the invention comprises a piezo actuator which transfers an electric energy directly to linear directional vibration energy instead of the prior vibration motor having eccentric weight as a vibration source, the size of the vibration means may be remarkably smaller than that of the prior bath, and the structure of the bath may be compact so that said bath may be more freely designed. And, the noise or vibration of said bath may be decreased because the weight of the vibration means is reduced. Further, according to the bath of the invention, the effect of a diet or pain treatment may be increased because the vibration period or the vibration strength may be controlled precisely in accordance with the health condition of the user or the purpose of treatment and so on.

What is claimed is:

1. A bath for generating water vibration wave comprising a bath (2) which has a water reservoir portion (3), a vibration generation means (10) which is positioned at one side of the bath (2), a vibration member (20) which is connected to the vibration generation means (10) and extended downwardly into the water reservoir portion (3), and a plurality of vibration blades (23) which are mounted at the vibration member (20) in a predetermined interval and vibrate as well as circulate the water in the bath (2);

wherein the vibration generation means (10) includes a support member (14) fixed at the bath (2) and a piezo actuator (16) which is fixed at the support member (14) and vibrated when the electricity is supplied.

2. A bath for generating water vibration wave of claim 1, wherein the support member (14) of the vibration generation means (10) is horizontally mounted at the upper side of the inner wall of the bath (2), and the piezo actuator (16) fixed on the support member (14) extends downwardly and a plurality of piezo element pieces are vertically oriented in the piezo actuator (16).

* * * * *